US009351551B2

(12) United States Patent
Morgan et al.

(10) Patent No.: US 9,351,551 B2
(45) Date of Patent: May 31, 2016

(54) PERSONAL ARMBAND STORAGE DEVICE

(71) Applicant: ARMPOCKET ENTERPRISES, Miramar, FL (US)

(72) Inventors: Mark E. Morgan, Miramar, FL (US); Jytte L. Nielsen, Miramar, FL (US)

(73) Assignee: ARMPOCKET ENTERPRISES, Miramar, FL (US)

( * ) Notice: Subject to any disclaimer, the term of this patent is extended or adjusted under 35 U.S.C. 154(b) by 66 days.

(21) Appl. No.: 14/068,185

(22) Filed: Oct. 31, 2013

(65) Prior Publication Data

US 2014/0054335 A1 Feb. 27, 2014

Related U.S. Application Data

(63) Continuation-in-part of application No. 13/245,454, filed on Sep. 26, 2011, now Pat. No. 8,752,740, which is a continuation-in-part of application No. 11/509,122, filed on Aug. 24, 2006, now abandoned.

(51) Int. Cl.
*A45F 5/00* (2006.01)
*A45C 11/00* (2006.01)

(52) U.S. Cl.
CPC . *A45C 11/00* (2013.01); *A45F 5/00* (2013.01); *A45C 2011/003* (2013.01); *A45F 2005/008* (2013.01); *A45F 2200/0516* (2013.01); *A45F 2200/0583* (2013.01)

(58) Field of Classification Search
CPC ..... A45F 5/00; A45F 2005/008; A45F 2200/0516; A45F 2200/0525; A45F 2200/0508
USPC ..... 224/219, 222, 267, 930
See application file for complete search history.

(56) References Cited

U.S. PATENT DOCUMENTS

| | | | | |
|---|---|---|---|---|
| 1,564,881 | A | 12/1925 | Montgomery | |
| D258,246 | S | 2/1981 | Kravchenko | |
| 4,314,569 | A | 2/1982 | Speno | |
| D265,861 | S | 8/1982 | Walasek | |
| 4,432,477 | A | 2/1984 | Haidt et al. | |
| 4,500,019 | A * | 2/1985 | Curley, Jr. | 224/222 |
| 4,509,667 | A | 4/1985 | Meldrum | |
| 4,601,418 | A | 7/1986 | Gruzensky | |
| 4,864,646 | A | 9/1989 | Nesbit et al. | |
| 4,865,191 | A * | 9/1989 | Easter | 206/316.3 |
| 4,871,597 | A | 10/1989 | Hobson | |

(Continued)

FOREIGN PATENT DOCUMENTS

| | | |
|---|---|---|
| AU | 200244464 | 12/2003 |
| CN | 201504718 U | 6/2010 |

(Continued)

OTHER PUBLICATIONS

PCT International Search Report for PCT/US07/19382.

(Continued)

*Primary Examiner* — Adam Waggenspack
(74) *Attorney, Agent, or Firm* — Marshall, Gerstein & Borun LLP

(57) ABSTRACT

A personal armband storage device includes a body portion having an opening for access to a storage compartment, a back plate attached to the body portion. The personal armband storage device is resistant to slippage during physical activity due to increased friction between the back plate and the upper arm.

13 Claims, 14 Drawing Sheets

(56) References Cited

U.S. PATENT DOCUMENTS

| | | | | |
|---|---|---|---|---|
| 4,881,684 | A | 11/1989 | Chinman | |
| 4,966,320 | A | 10/1990 | DeSantis et al. | |
| 5,003,637 | A | 4/1991 | Lonon | |
| 5,009,347 | A | 4/1991 | Phelps | |
| 5,309,328 | A * | 5/1994 | Lum | A45F 5/00 2/170 |
| 5,427,290 | A | 6/1995 | Thatcher | |
| 5,505,356 | A | 4/1996 | Noriega et al. | |
| 5,511,702 | A | 4/1996 | Yang | |
| D371,675 | S | 7/1996 | Carter | |
| D373,900 | S | 9/1996 | Montgomery, Sr. | |
| 5,586,706 | A | 12/1996 | Ritzenhein | |
| 5,586,969 | A | 12/1996 | Yewer, Jr. | |
| 5,588,571 | A | 12/1996 | Mazzo | |
| 5,595,167 | A | 1/1997 | Scott | |
| 5,625,904 | A | 5/1997 | Kline | |
| 5,711,469 | A * | 1/1998 | Gormley et al. | 224/675 |
| 5,725,486 | A | 3/1998 | Engelman | |
| 5,779,122 | A | 7/1998 | Martinelli | |
| D406,455 | S | 3/1999 | Wagner, II | |
| 5,924,136 | A | 7/1999 | Ogean | |
| 5,937,841 | A | 8/1999 | Summers et al. | |
| 5,938,089 | A | 8/1999 | Abreu-Marston | |
| D414,929 | S | 10/1999 | Brucki | |
| 6,006,915 | A * | 12/1999 | Moor | 206/579 |
| 6,047,064 | A | 4/2000 | Lyons | |
| 6,095,389 | A | 8/2000 | Fenton et al. | |
| 6,213,304 | B1 | 4/2001 | Juliussen | |
| 6,227,424 | B1 | 5/2001 | Roegner | |
| 6,330,961 | B1 | 12/2001 | Borja | |
| 6,443,341 | B1 | 9/2002 | Rittmann | |
| 6,568,574 | B2 | 5/2003 | Jones et al. | |
| 6,629,628 | B1 | 10/2003 | Canepari et al. | |
| D490,974 | S | 6/2004 | Wagner, II | |
| D512,834 | S | 12/2005 | Wagner, II | |
| D513,865 | S | 1/2006 | Wagner, II | |
| 7,048,162 | B2 | 5/2006 | Frye et al. | |
| D541,042 | S | 4/2007 | Andre et al. | |
| D541,044 | S | 4/2007 | Wagner, II | |
| D554,365 | S | 11/2007 | Zhou | |
| 7,320,318 | B1 | 1/2008 | Tentler | |
| D576,791 | S | 9/2008 | Wagner, II | |
| D576,792 | S | 9/2008 | Wagner, II | |
| 7,578,006 | B2 * | 8/2009 | Garneau | 2/161.1 |
| D607,198 | S | 1/2010 | Andre et al. | |
| D620,706 | S | 8/2010 | Wagner, II | |
| D622,058 | S | 8/2010 | Wagner, II | |
| D623,404 | S | 9/2010 | Andre et al. | |
| D628,375 | S | 12/2010 | Andre et al. | |
| D651,793 | S | 1/2012 | Willows et al. | |
| D666,409 | S | 9/2012 | Andre et al. | |
| D680,326 | S | 4/2013 | Willows et al. | |
| D680,327 | S | 4/2013 | Willows et al. | |
| D680,736 | S | 4/2013 | Willows et al. | |
| 8,413,613 | B1 | 4/2013 | Smith | |
| D681,945 | S | 5/2013 | Willows et al. | |
| 8,474,669 | B2 | 7/2013 | Rohrbach et al. | |
| 2003/0062391 | A1 * | 4/2003 | Mitchell | 224/576 |
| 2003/0222109 | A1 * | 12/2003 | Weiss | 224/222 |
| 2004/0144815 | A1 | 7/2004 | Reid | |
| 2004/0206791 | A1 | 10/2004 | Rogers | |
| 2004/0251285 | A1 | 12/2004 | O'Neill | |
| 2005/0142334 | A1 * | 6/2005 | Mikata et al. | 428/190 |
| 2005/0145657 | A1 * | 7/2005 | Norberg | 224/222 |
| 2006/0041985 | A1 | 3/2006 | Godshaw | |
| 2006/0201595 | A1 | 9/2006 | Carmichael | |
| 2006/0266776 | A1 | 11/2006 | Plakke | |
| 2007/0039086 | A1 | 2/2007 | Moore | |
| 2008/0011794 | A1 | 1/2008 | Daniel | |
| 2008/0017678 | A1 * | 1/2008 | Anderson | A44C 5/003 224/221 |
| 2008/0023508 | A1 * | 1/2008 | Harchol | A45F 5/02 224/183 |
| 2008/0216211 | A1 | 9/2008 | Dolby | |
| 2009/0050246 | A1 | 2/2009 | Godshaw et al. | |
| 2009/0300823 | A1 | 12/2009 | Connaghan et al. | |
| 2010/0032462 | A1 | 2/2010 | Cameron et al. | |
| 2012/0074184 | A1 | 3/2012 | Morgan et al. | |
| 2012/0152990 | A1 | 6/2012 | Kulas | |
| 2013/0256346 | A1 | 10/2013 | Rohrbach et al. | |

FOREIGN PATENT DOCUMENTS

| | | | |
|---|---|---|---|
| DE | 20308250 | U1 | 8/2003 |
| EP | 1011374 | B1 | 6/2000 |
| EP | 1704796 | A1 | 9/2006 |
| GB | 2157942 | A | 11/1985 |
| GB | D4028762 | | 2/2013 |
| JP | 2003153053 | A | 5/2003 |
| JP | 2004049293 | A | 2/2004 |
| JP | 2009280951 | A | 12/2009 |
| KR | 468009 | | 7/2013 |
| TW | 311303 | | 5/2007 |
| WO | WO-DM048120 | A1 | 5/1999 |
| WO | WO-DM049933 | | 9/1999 |
| WO | WO-2008/024521 | A2 | 2/2008 |

OTHER PUBLICATIONS

Written Opinion of the International Search Authority for International Application No. PCT/US07/19382.

Extended European Search Report for EP 07 83 7756, dated Dec. 7, 2010.

Extended European Search Report for Application No. 12155627, dated Apr. 5, 2013.

Color photograph of Amphipod Armpod SmartView Plus (Sep. 19, 2012).

Workout Armband—Premium 2013 Version, downloaded from the Internet at: <http://www.accessorystoreoutlet.com/collections/iphone-5-accessories/products/workout-armband>.

Amazon.com search results for Armbands for smartphones.

Extended Search Report for European Application No. 13198465, dated Feb. 4, 2015.

* cited by examiner

PERSONAL ARMBAND STORAGE DEVICE

CROSS-REFERENCE TO RELATED APPLICATIONS

This application is a continuation-in-part of U.S. patent application Ser. No. 13/245,454, filed on Sep. 26, 2011, which is a continuation-in-part of U.S. patent application Ser. No. 11/509,122, filed on Aug. 24, 2006, the entirety of both U.S. patent application Ser. Nos. 13/245,454 and 11/509,122 are hereby incorporated by reference herein.

BACKGROUND OF THE INVENTION

The invention generally relates to personal item carrying devices or personal item storage devices, and more specifically to personal item storage devices that may be attached to, or carried on, an individual's arm.

RELATED TECHNOLOGY

Efficient transportation of small personal items has presented a challenge for many years. Small personal items may be carried in pockets of clothing, but when carried in this manner, small personal items are susceptible to falling out of the pocket, especially during vigorous physical activity. In order to solve this problem, zippers or other closure devices have been incorporated into clothing pockets. However, transportation of small personal items remains a challenge when wearing clothing lacking pockets or when participating in physical activities that subject the wearer and pocket contents to bouncing, bruising or damage, for example when running, weight-lifting, cycling or participating in aerobic exercise.

Storage devices that are attached to the body were developed for less physically demanding situations as they could not withstand the forces and accelerations incurred during intense physical activity. One example of such a device is the waist or "fanny" pack. This type of device includes a central storage chamber that is connected at opposite sides to a belt. This type of device is designed to be worn as a belt with the storage compartment located on a user's front or back. While such devices are capable of transporting small personal items, the location of the storage compartment was inconvenient and/or hard to access, or the personal items became crushed when sitting. Small backpacks suffer from the same problem. Moreover, backpacks and waist packs are generally larger than needed for carrying only a few small items, making them less desirable for vigorous physical activity. Other carrying devices include armbands designed to carry a single electronic device. These armbands are uncomfortable and slip down the user's arm due to sweat and oil accumulating between the user's skin and the armband. With the advent of larger smartphones and similar electronic devices, in order to prevent these devices from slipping down the arm, a user must pull the armstrap so tightly that it becomes a tourniquet restricting blood-flow, which is uncomfortable and impractical during exercise.

Recently portable electronic devices, such as personal music playing devices and cellular telephones with various applications, have become small enough to be carried in backpacks or waist packs. However, these backpacks and waist packs are located relatively far away from the ears, which need to be connected to head-phones or ear-buds. In addition, these devices are not readily accessible for application operation or music selection as they must be secured inside these carry devices.

Additionally, many professions require workers to keep their company identification always visible for security purposes. In jobs requiring manual labor, many times attaching the ID to clothing or using a neck-lanyard can result in detachment or endanger the wearer through entanglement. These individuals need to carry cell phones or other portable electronic devices which cannot be carried inside normal pockets with damage or injury. Additionally, many individuals exercise outdoors after dark and use hand-held flashlights for illumination. Similarly, some tasks are performed in low-light conditions (e.g., plumbing, auto mechanical repairs, some household chores) which also require some sort of external lighting. While so called "miner's headlamps" may be used in some instances, these devices may be uncomfortable and may leave marks on the forehead. Additionally, these devices are difficult to adjust once placed on the forehead.

During endurance-type sporting events, in addition to portable music players a cellular phones with performance monitoring applications, athletes often carry some quantity of energy bars and/or energy gels for caloric and electrolyte replenishment during the activity. Some high-energy consuming, strenuous activities include distance running, biking, or some combination of both, such as triathlons. In addition, athletes participating in such high-energy consuming activities also generally desire to securely carry other small items, such as a car key, a house key or a locker key, as well as an identification card, cash, or credit cards. While some attempts have been made to produce small carrying devices that are attachable to various extremities of the body, such as the arm, leg, or head, such devices are subject to slippage or movement during physical activity. This slipping phenomenon is generally due to the decrease in friction created when sweat or other liquid becomes trapped between the carrying device and the skin. When friction is decreased between the carrying device and the body, the carrying device is subjected to forces generated during the physical activity, such as the swinging of arms during aerobic activities involving running, or jumping, or the rapid bouncing movements resulting from bicycling over rough terrain or even riding a wildly gyrating theme park roller coaster.

Thus far, the only way to increase friction between the carrying device and the body has been to tighten a narrow attachment strap, which may result in loss of blood circulation to body parts located distal to the carrying device. This can be a major problem during participating in athletic events. Moreover, the resultant loss of blood circulation is detrimental to performance, is uncomfortable, and can result in injury.

SUMMARY

In one embodiment, a personal armband storage device includes a body portion having an opening for access to a storage compartment, a back plate attached to the body portion for supporting the back plate on the upper arm of a user, and a strap attached to the body portion for securing the body portion to the upper arm.

In another embodiment, the back plate includes a first region having a first thickness and a second region having a second thickness, the second thickness being greater than the first thickness, the first region including a first portion and a second portion that are located laterally outward from the second region, the second region being located between the first portion and the second portion of the first region.

In yet another embodiment, the back plate may include a plurality of channels formed in an outer surface, the plurality of channels opening away from the body portion, and the plurality of channels directing fluids away from the body portion.

In yet another embodiment, the body portion may include a transparent window and a window strap located within the storage compartment, the window strap being located adjacent to an inner surface of the window.

BRIEF DESCRIPTION OF THE DRAWINGS

The invention will now be described in further detail, by way of example only, with reference to the accompanying drawings in which.

DETAILED DESCRIPTION

Figure 1:
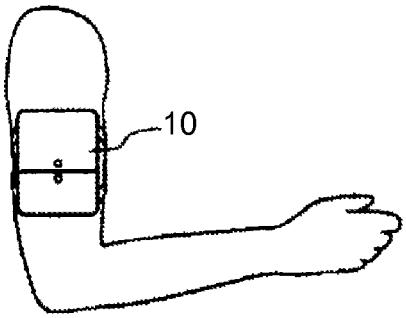
FIG. 1 illustrates one embodiment of a personal armband storage device constructed in accordance with the teachings of the disclosure.
Figure 2:
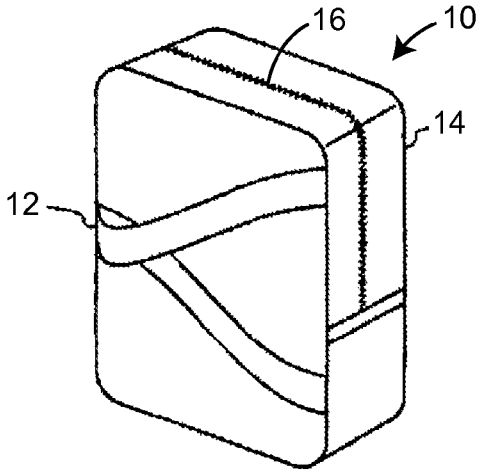
FIG. 2 illustrates a back perspective view of the personal armband storage device of FIG. 1.

Referring now to FIGS. 1 and 2, a personal armband storage device 10 is illustrated. The personal armband storage device 10 may include a V-shaped strap 12, attached to a body portion 14. A storage compartment may be accessed through an opening 16. Personal items may be carried in the storage compartment during virtually any type of physical activity.

Figure 3:
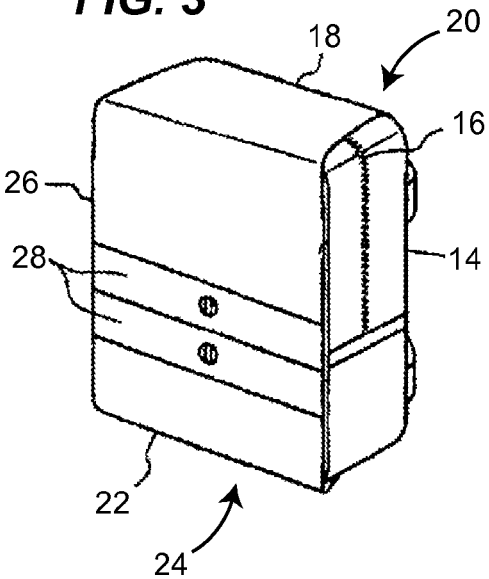
FIG. 3 illustrates a front perspective view of the personal armband storage device of FIG. 1.

Referring to FIG. 3, the personal armband storage device 10 may include a dual flap closure having an upper flap 18 extending from a top 20 of the body portion 14 and a lower flap 22 connected to a bottom 24 of the body portion 14. In a closed position, the upper flap 18 and the lower flap 22 are secured to a front 26 of the body portion 14. The upper flap 18 and lower flap 22 open in opposing directions when a securing mechanism 28 is released. The securing mechanism 28 may include an elastic band, hook and loop fasteners, buttons, or virtually any other type of releasable connection. When the upper flap 18 is opened, a user has access to an interior of the body portion 14 through the opening 16. The opening 16 may include any type of releasable opening mechanism, such as a zipper, buttons, hook and loop fasteners, etc.

Figure 4:
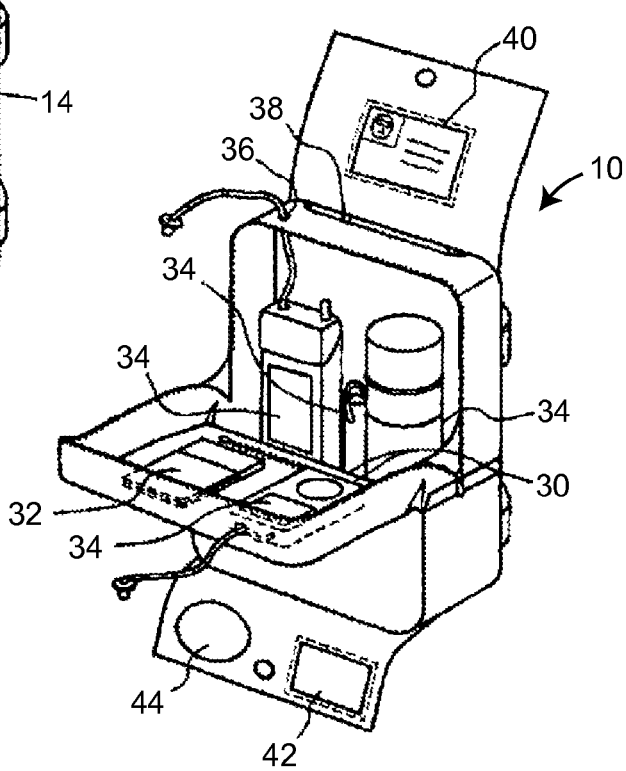
FIG. 4 illustrates a front perspective view of the personal armband storage device of FIG. 1 with a storage compartment exposed.

Referring to FIG. 4, one or more integrated compartments may be separated by a removable central dividing compartment 30 that is attached to an interior of the body portion 14 by a removable connection, such as zippered connection or by hook and loop fasteners, for example. The integrated compartments may include card holders 32 and one or more expandable retaining compartments 34, which may be sized to hold personal objects such as a tool, a cell phone, an earpiece, a glucose testing kit, a lipstick, a medication bottle, or a portable music player, for example. One or more of the integrated compartments may include a window that allows cell phone or music player operation without removing the cell phone or music player from the integrated compartment. One or more earpiece holes 36 may be located at a top 20 of the body portion 14 to allow electronic earpiece cords to extend from within the storage compartment of the body portion 14 to outside of the body portion 14. An elastic loop 38 may be included on an outside of the body portion 14, but below one of the flaps 18, 22 for retaining a pen, for example.

A transparent window 40 may be provided to show contents within an additional compartment, such as an identification card. Another additional compartment 42 may be integrated into the lower flap 22, which may also include a minor 44, for example.

Figure 5:
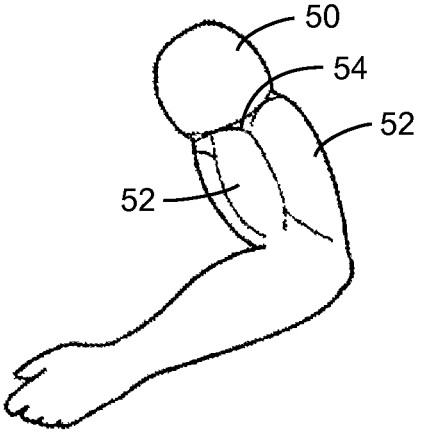
FIG. 5 illustrates musculature and contours of the human arm that are mirrored by a multi-layering of visco-elastic memory foam back plate of the personal armband storage device of FIG. 1.

Referring to FIG. 5, musculature and contours of the human upper arm are illustrated, which are mirrored in the construction of a back plate of the personal armband storage device. The human upper arm naturally includes a recess 54 where muscles of the shoulder 50 (i.e., the deltoids) meet the muscles of the upper arm 52 (i.e., the triceps and biceps). This recess forms a stable supporting location for the personal armband storage device 10. The back plate (described further below) varies in thickness to minor the physical contours of the upper arm. For example, the back plate may include a thicker portion that fits neatly within the recess 54 of the upper arm. This complimentary shape provides additional stability and support for the personal armband storage device during strenuous physical activity.

Figure 6:
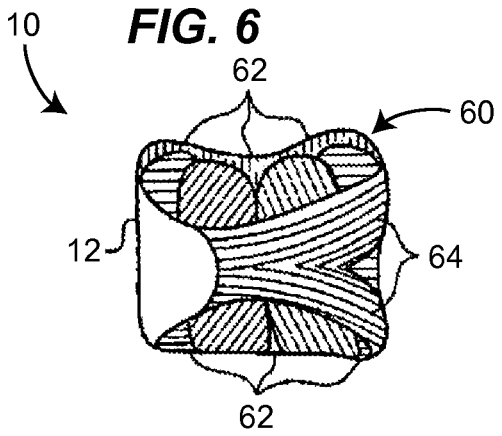
FIG. 6 illustrates the back plate of the personal armband storage device of FIG. 1, including a multi-layered padding constructed of visco-elastic memory foam fashioned to mirror the contours of the musculature of the upper human arm connected to a V-shaped strap.
Figure 15:
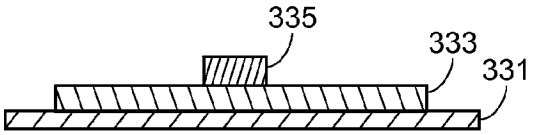
FIG. 15 is a cross-sectional view of a back plate, with multiple layers of padding, of the personal armband storage device of FIG. 11, taken along line 15-15 of FIG. 12.

The back plate 60 illustrated in more detail in FIG. 6. The back plate 60 includes a multi-layered webbing 62, which may be constructed of visco-elastic memory foam material that is connected to the V-shaped strap 12. As discussed above, the multi-layered webbing 62 is shaped to mirror the natural contours of the human arm shown in FIG. 5. Other examples of the multi-layered webbing 62 will be discussed in more detail with respect to FIGS. 12 and 15. The V-shaped strap 12 may be formed from an abrasion-resistant, durable, and breathable material like Hypalon or Neoprene. The V-shaped strap 12 may also include laminated construction (versus sewing), thermo-molded construction techniques, and additional Brock-type, and/or breathable interior foam padding. In the embodiment of FIG. 6, the V-shaped strap 12 includes two separated end portions 64 that are attached to a side of the body portion 14. The separated end portions 64 (which form the V-shape) provide additional stability to the personal armband storage device 10 when located on the upper arm. The separated end portions 64 provide additional contact area between the V-shaped strap 12 and the upper arm, which increases friction and reduces slipping during physical activity.

Figure 7:
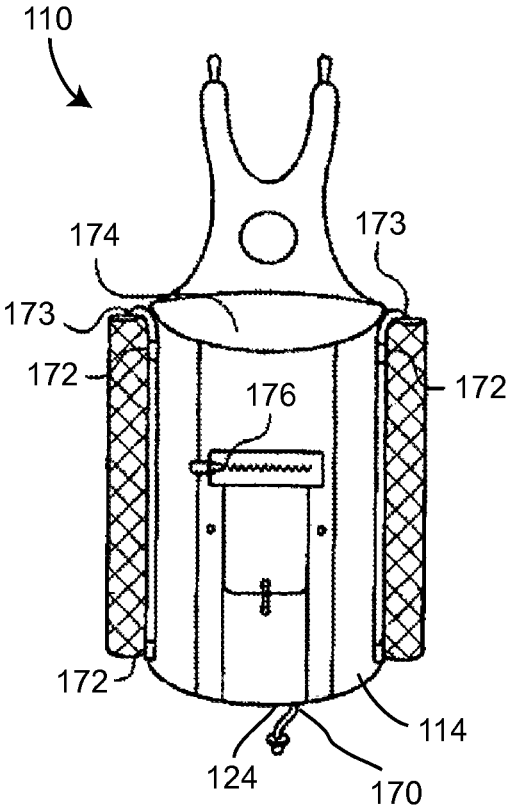
FIG. 7 illustrates a front view of an alternate embodiment of a personal armband storage device constructed in accordance with the teachings of the disclosure in an open position, including a storage space for a beverage container.

FIG. 7 illustrates a front view of another embodiment of the personal armband storage device 110 in an open position. A V-shaped strap (not shown) may be connected to a body portion 114 as in other embodiments. The personal armband storage device 110 illustrated in FIG. 7 may be shaped to carry a water container or other beverage container. Alternatively, a user may insert a collapsible water bladder into an insulated storage compartment, and a reinforced bottom 124 may include a drink-tube access port 170, with tube attachments 172 located along a side and/or a top of the body portion 114, which may allow a drinking tube 173 to wrap around the body portion 114 with enough length so the user can drink from the tube while wearing the personal armband storage device 110. The interior 174 of the personal armband storage device 110 may include one or more storage compartments, as in other embodiments, that are sized and shaped to hold a cell-phone, an MP3 or a music player, one or more keys, along with partitions for credit cards and/or a see-through ID compartment, for example. The personal armband storage device 110 may also include a zippered utility compartment 176 for keys or other items. The interior 174 of the personal armband storage device 110 may include a durable insulating layer made of an insulating material, such as denier nylon, polyurethane, foil backed bubble or other insultote-type insulating material to insulate a beverage container when placed in the interior 174.

Figure 8:
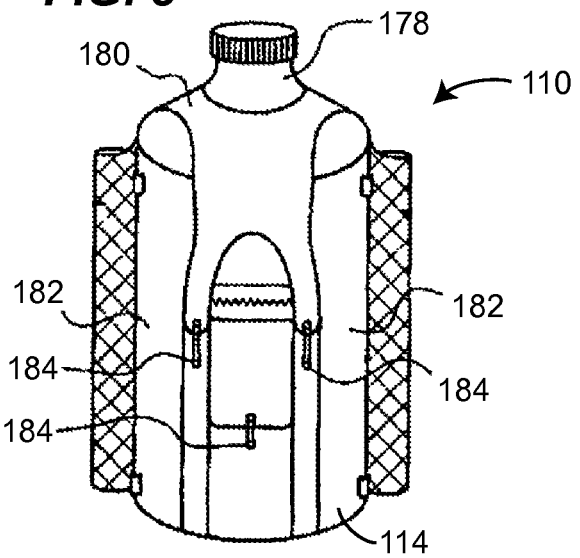
FIG. 8 illustrates a front view of the personal armband storage device of FIG. 7 in a closed or secured position and a beverage container disposed in the storage space.

Referring to FIG. 8, the personal armband storage 110 device is illustrated in the closed/secured position, and can carry a variety of beverage containers 178. The beverage container 178 may be secured in the closed position by one or more bungee closures 180 that are securable to a front of the body portion 114. The bungee closures 180 and side panels 182 may be constructed of an expandable, neoprene or polyurethane-type material that accommodate a wide range of beverage container sizes and shapes. The bungee closures 180 may be secured with one or more bungee connectors 184, thereby further expanding the range of beverage containers that can comfortably fit into this invention's expandable, insulated interior compartment.

Figure 9:
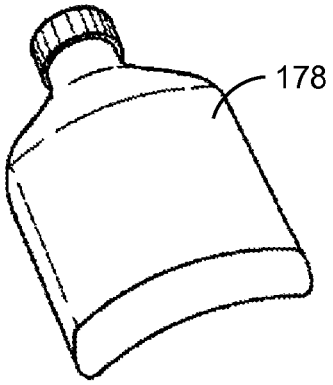
FIG. 9 illustrates a perspective view of a low-profile beverage container that may be used with the personal armband storage device of FIG. 7.

Referring to FIG. 9, a low-profile beverage container 178 may be constructed of various lightweight materials and shaped to mirror the natural contours of the human upper arm, thereby allowing the user to carry a beverage in the personal armband storage device while participating in vigorous activities.

Figure 10:
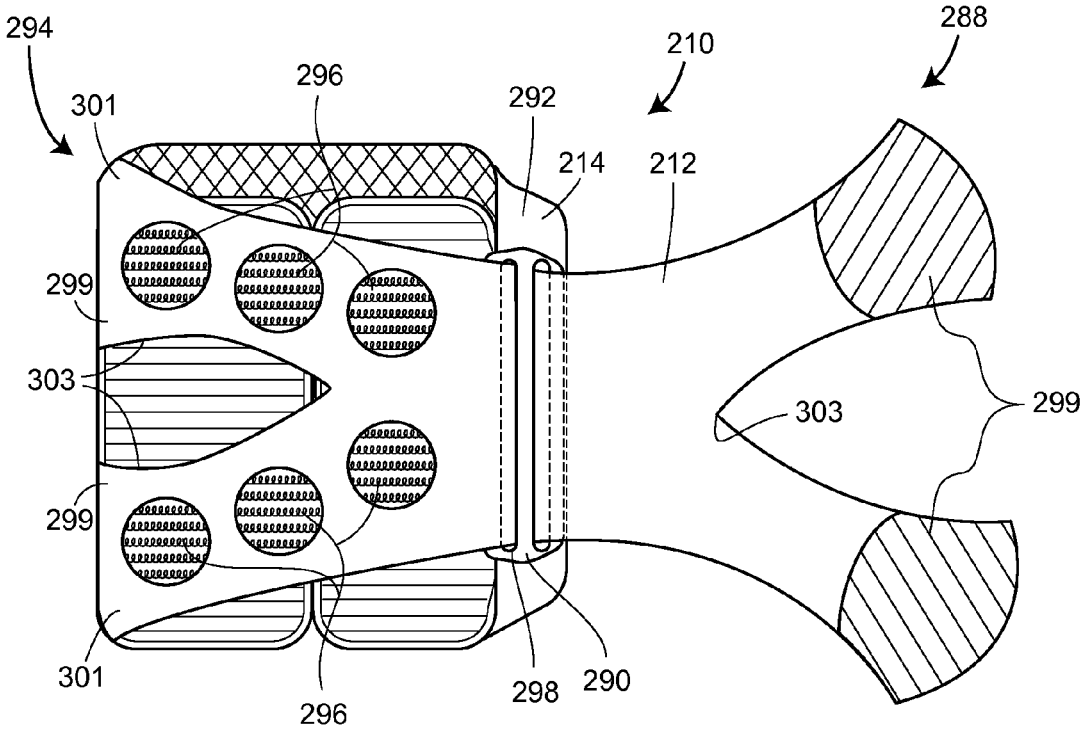
FIG. 10 is a back view of yet another embodiment of the personal armband storage device including a V-shaped strap that extends through a sizing device that is stitched into an edge of the personal armband storage device.

Referring to FIG. 10, another embodiment of the personal armband storage device 210 may include a V-shaped strap 212 that may be constructed of a soft, expandable, polyurethane or neoprene-type material. A first end 288 of the V-shaped strap 212 may extend through a sizing device 290, which may be single or double looped, which is stitched into one edge 292 of the body portion 214. After extending through the sizing device 290, the first end 288 of the V-shaped strap 212 may reverse direction and fold back over itself, and be secured to a second V-shaped end 294 with hook-and-loop fasteners 296, for example. The sizing device 290 may be separated from the user's arm by a padded neoprene or other soft material flap 298. In this embodiment, the V-shaped strap 212 includes opposing spit end portions 299, each opposing split end 299 including a pair of extensions 301 separated from one another at one end, but being attached at another end along a common interior edge 303. In this embodiment, the V-shaped strap 212 forms an extended X-shape by having the opposing split end portions 299.

Figure 11:
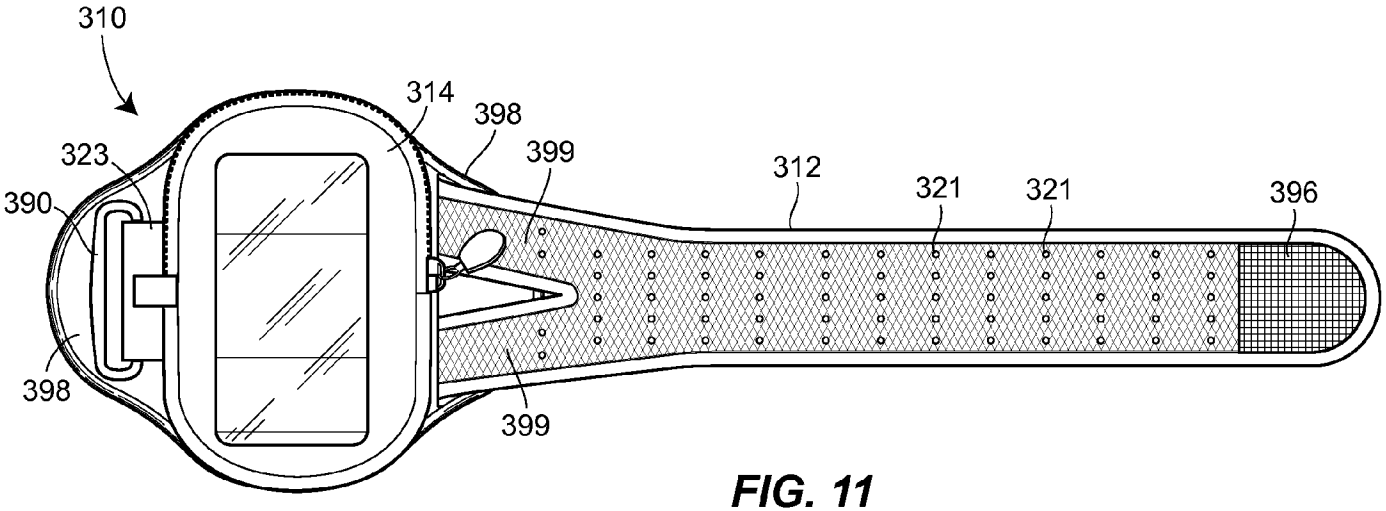
FIG. 11 is a front plan view of yet another alternate embodiment of a personal armband storage device constructed in accordance with the teachings of the disclosure.

FIG. 11 illustrates yet another embodiment of the personal armband storage device 310. In this embodiment, the V-shaped strap 312 is attached to one side of the body portion 314 at the split end by the extensions 399. The V-shaped strap 312 may include one or more perforations 321 that allow air to circulate between the V-shaped strap 312 and the user's arm. In one embodiment, the perforations 321 may be approximately 1 mm in diameter, which results in efficient air movement, sweat evaporation, and cooling. The V-shaped strap 312 may be made of a flexible material, such as neoprene and elastic, along with a moisture-wicking material, such as charcoal bamboo mesh. Bamboo mesh has the added benefit of inhibiting the growth of bacteria, mold, and mildew. One end of the V-shaped strap 312 may include one part of a hook and loop fastener 396. At another side of the body portion 314, the sizing device 390 may be attached with a fabric connector 323. The soft material flap 398 may extend from one or both sides of the body portion 314 to protect a user's arm from the sizing device 390 and/or the V-shaped strap 314.

Figure 12:
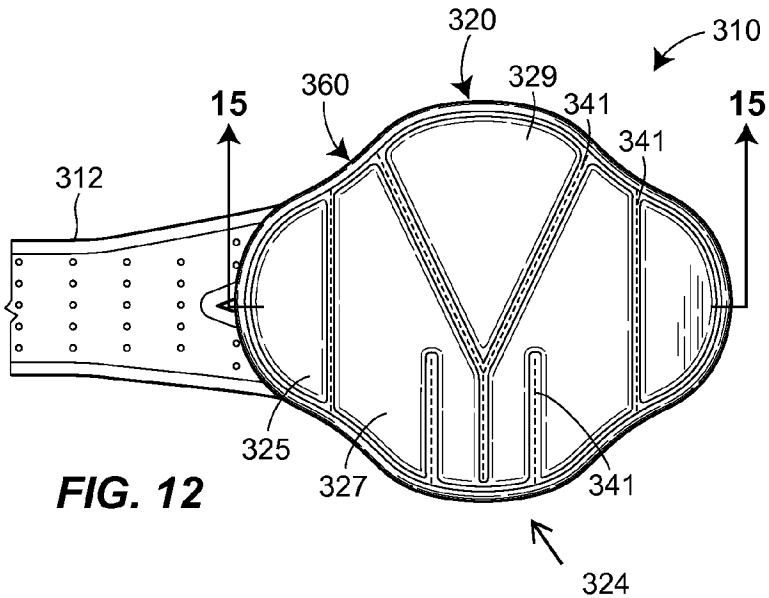
FIG. 12 is a back view of a body portion of the personal armband storage device of FIG. 11.

Turning now to FIG. 12, a back of the body portion 314 may include a multi-layered back plate 360 that is formed to mirror the contours of the human upper arm, as discussed above. The disclosed back plate 360 effectively increases contact area with the arm. This increased contact area increases friction against the skin or shirtsleeve, which results in resistance to slipping due to sweat or moisture accumulation. The back plate 360 may include a first region 325, a second region 327 that is thicker than the first region 325, and a third region 329 that is thicker than both the first and second regions 325, 327. The differences in thickness may be formed by varying a number of layers of material that make up each region. For example, a first layer 331 (FIG. 15) may extend across each of the first, second, and third regions 325, 327, 329, respectively. A second layer 333 may extend across only the second and third regions 327, 329, respectively. A third layer 335 may extend across only the third region 329. The third region 329 may have a generally "pie slice" shape. In other words, the third region 329 may be wider near a top 320 of the body portion 314 than near a bottom 324 of the body portion 314. The third region 329 is formed to fit neatly within the recess in the human upper arm formed by the deltoid and biceps and triceps muscles, as discussed above. In this way, the third region 329 increases the effective contact area of the device, provides additional friction to prevent slipping, and stabilizes and supports the personal armband storage device 310 on the human upper arm when worn by a user. In other embodiments, the first region 325, the second region 327, and the third region 329 may be formed from a single layer of material that varies in thickness.

Unlike other types of foam padding, molding characteristics of visco-elastic memory foam used to form at least a portion of the back plate 360 produces a customized, tailored fit to the musculature, size and shape of any user's arm, thereby facilitating a comfortable and virtually no-slip contact with the wearer's arm. In addition, visco-elastic foam provides the added benefit of protecting the wearer's arm from sharp objects that may be carried internally in the storage compartment in addition to shock absorption in case of collision or if the storage device is accidently dropped.

In one embodiment, each layer 331, 333, 335 may be approximately 3 mm thick. However, other embodiments may include one or more layers that are in the range of between 1 mm and 5 mm thick. The layers 331, 333, 335 may be covered by a moisture-wicking fabric, such as polyester "dry-max" fabric or charcoal bamboo rayon. The back plate 360 may include one or more channels 341 that direct sweat or other moisture away from the wearer's arm. By forming the back plate 360 of visco-elastic memory foam and a semi-coarse moisture-wicking mesh fabric, air is free to circulate through the material allowing for increased moisture evaporation and cooling. In this way, the back plate 360 remains relatively dry, which produces friction between the back plate 360 and the upper arm. Therefore, the personal armband storage device 310 is less susceptible to slippage during physical activity, which is a problem in prior art storage devices.

Figure 13:
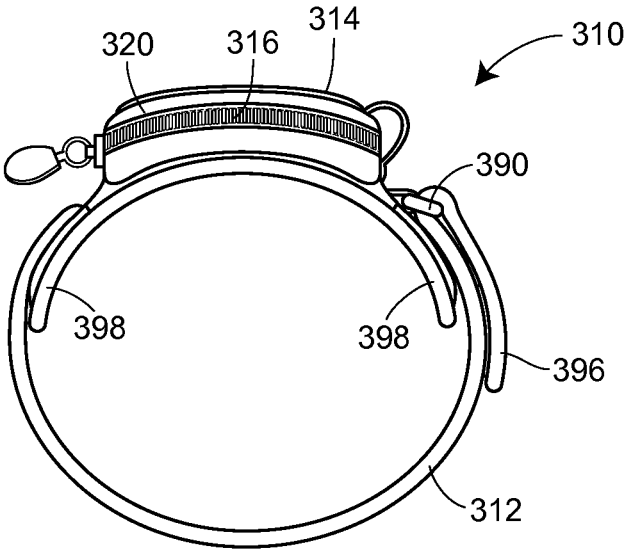
FIG. 13 is a top view of the personal armband storage device of FIG. 11.
Figure 14:
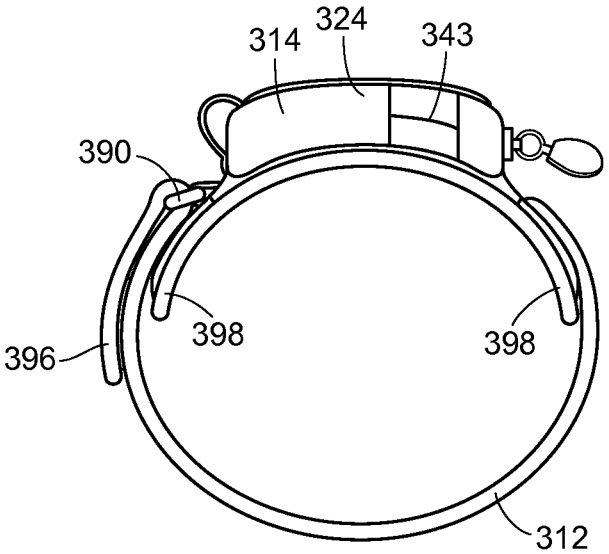
FIG. 14 is a bottom view of the personal armband storage device of FIG. 11.

Referring now to FIGS. 13 and 14, top and bottom views of the personal armband storage device 310 are illustrated in an attached position (e.g., the V-shaped strap 312 extends through the sizing device 390 and is attached to itself forming a closed loop). The top 320 of the body portion 314 includes an opening 316 that includes a releasable fastener, such as a zipper or hook and loop fastener, to allow a user to selectively open and close the opening 316 for accessing an interior storage compartment. The bottom 324 of the body portion 314 may include an access port 343 sized to allow a portion of a device within the storage compartment, such as a music player or cell phone ear piece cord, to extend out of the storage compartment so that a user may use the device while the device is stored within the storage compartment. The access port 343 may be formed of overlapping fabric, in one example. Other examples of access ports include flexible plastic or rubber petals. Regardless, an opening of the access port 343 must be flexible enough to allow a larger end (such as an earpiece, or a plug) to pass through the opening so that a cord may be threaded through the opening and connected to the device within the storage compartment. The access port 343 may form a water resistant seal that prevents damage to electronic devices stored within the storage compartment from environmental factors, such as dust, dirt, sand, water, sweat, etc.

Figure 16:
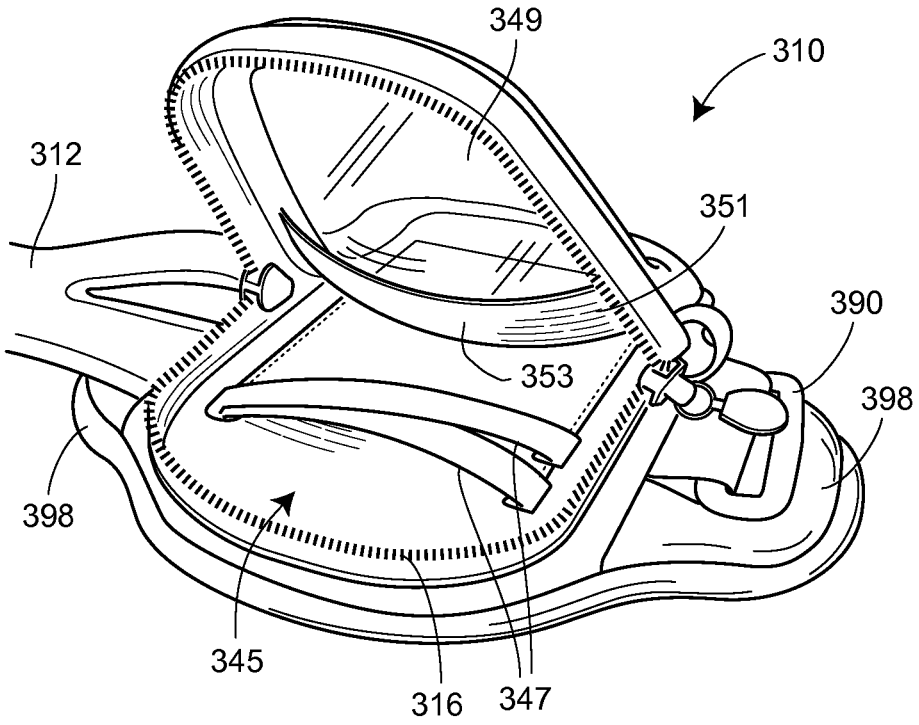
FIG. 16 is a top perspective view of the personal armband storage device of FIG. 11 with a storage compartment in an open position, exposing a plurality of storage pockets.
Figure 19:
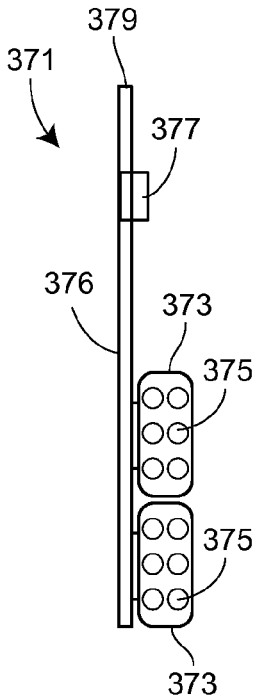
FIG. 19 is a side view of an illumination assembly that may be disposed within the storage compartment of the personal armband storage device of FIGS. 17 and 18.

FIG. 16 illustrates the personal armband storage device 310 in an open configuration in which a user may access the storage compartment 345 through the opening 316. The storage compartment may include one or more expandable storage pockets 347 for securing items such as car keys, credit cards, identification cards, etc. One or more of the storage pockets 347 may include a clipped or angled top edge, which facilitates insertion of items into the pockets 347. A front of the storage compartment may include a transparent window 349 to allow a user to view and operate an electronic device (not shown) located in the storage compartment 345. The window 349 may allow capacitance, pressure, or heat based operation of the electronic device through the window 349. For example the window 349 allows a user to operate a cell phone or a music player having a touch-screen by touching the window, which transfers the capacitance, pressure, or heat to the touch-screen. The window 349 is made from material that allows the touch to be recognized by the touch-screen of the electronic device. Alternatively, the window may allow a worker to safely and securely keep an ID card visible while keeping portable electronic devices and other personal items secure and accessible. An elastic strap 351 may be attached to the storage compartment 345 proximate an inner surface of the window 349. The elastic strap 351 may be configured to hold an electronic device securely within the storage compartment 345 and against the window 349 to ensure electronic device operation when activated by the user through the window. The elastic strap 351 may include silicone coatings 353 on one or both sides to further secure an electronic device against the window 349.

Figure 17:
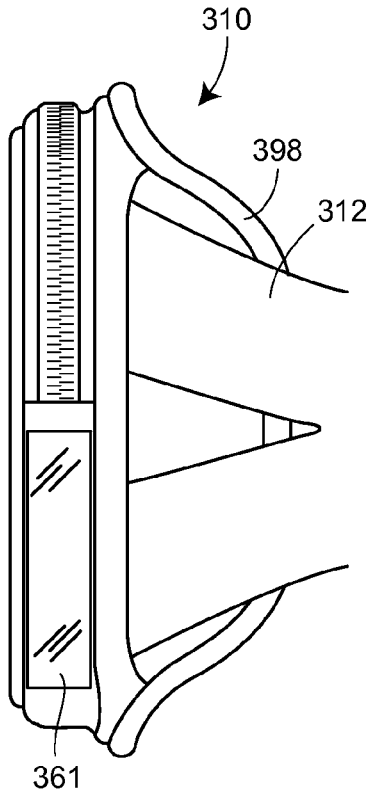
FIG. 17 is a side view of the personal armband storage device of FIG. 11, including a window capable of allowing a light source to project through the window.
Figure 18:
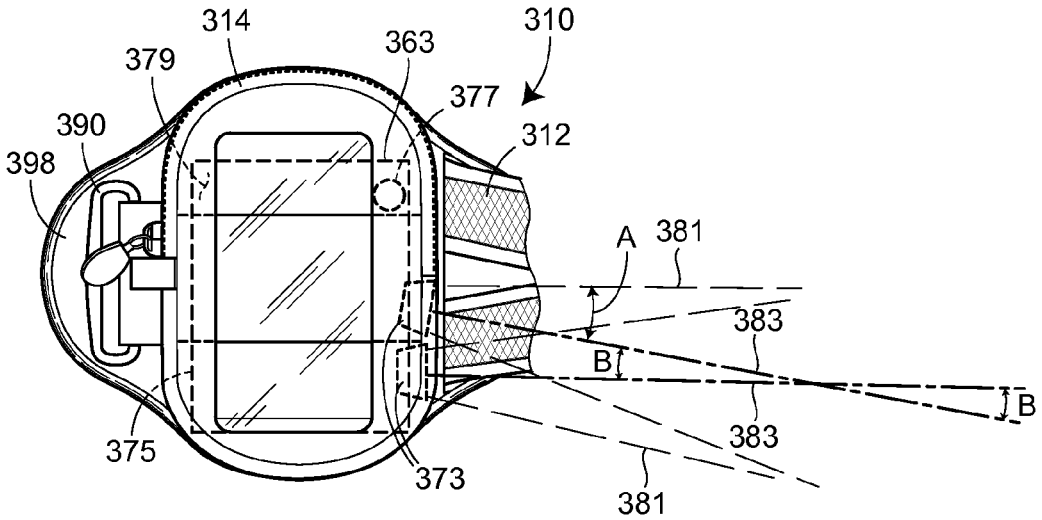
FIG. 18 is a front view of the storage section of the personal armband storage device of FIG. 17, including portions of an illumination assembly illustrated in phantom.
Figure 21:
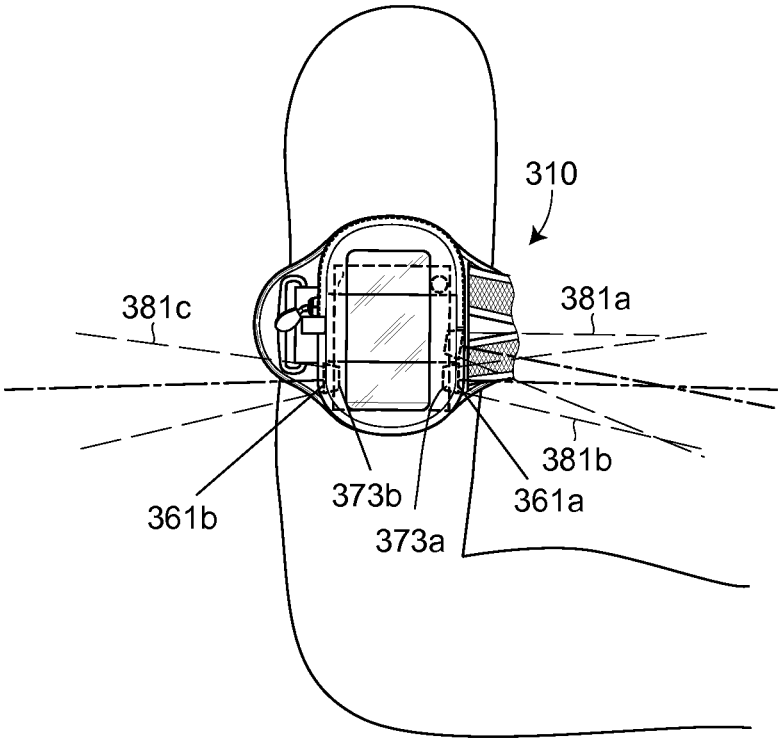
FIG. 21 is a front view of the storage section of an alternate embodiment of the storage section of a personal armband storage device, including a plurality of windows capable of allowing a light source to project through each window.
Figure 22:
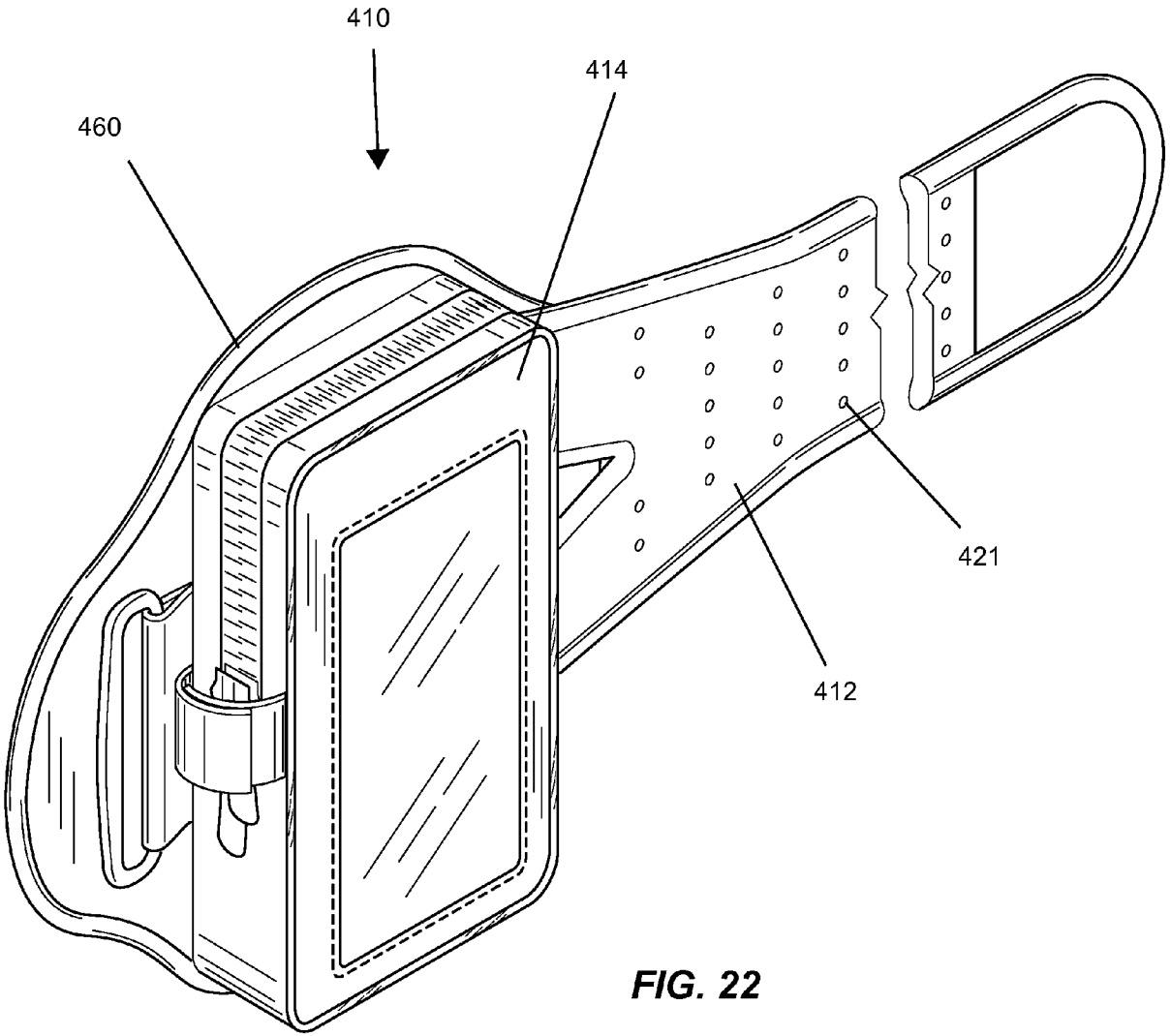
FIG. 22 is a front perspective view of yet another alternate embodiment of a personal armband storage device constructed in accordance with the teachings of the disclosure.
Figure 23:
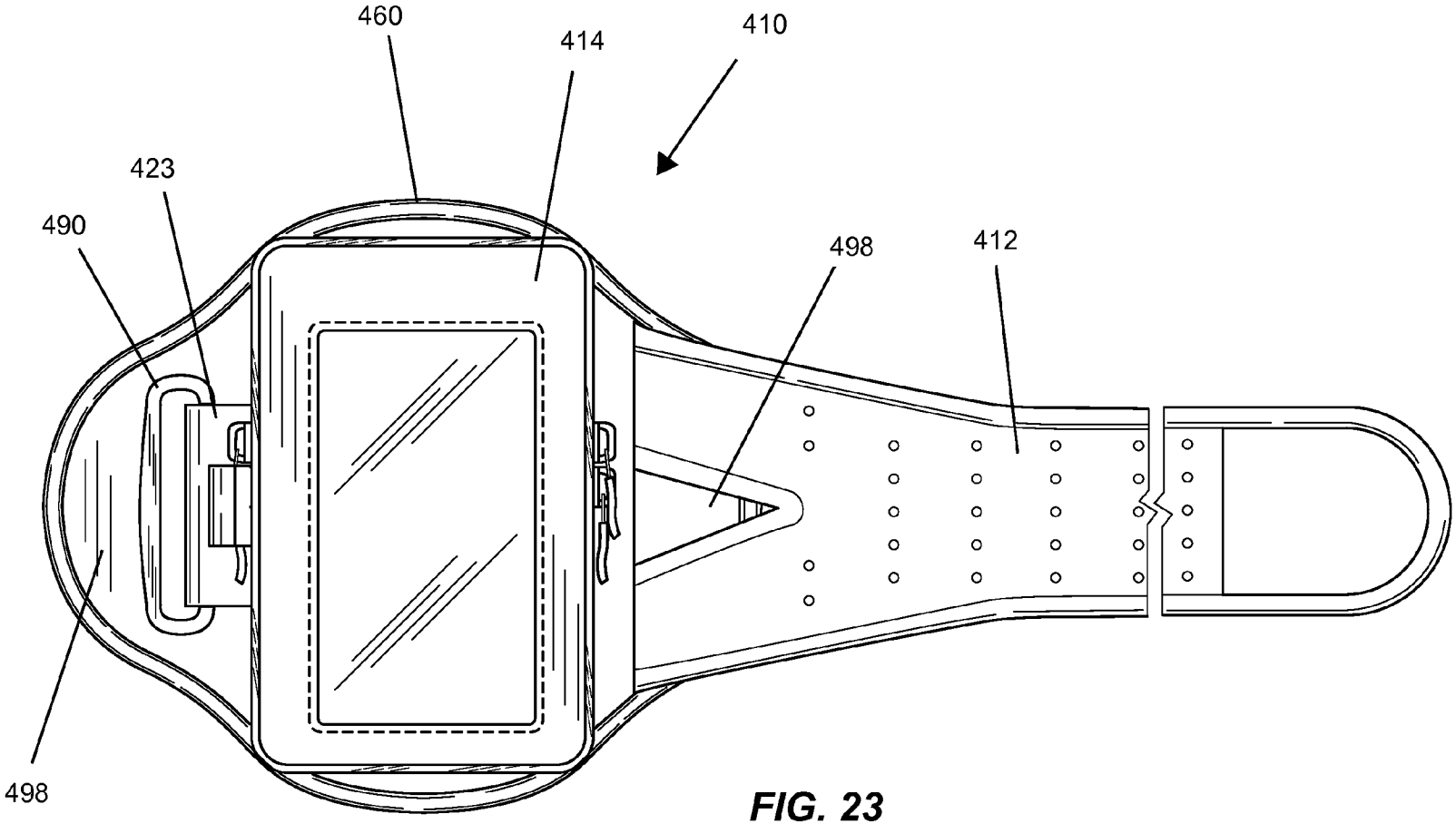
FIG. 23 is a front plan view of the personal armband storage device of FIG. 22.

Turning now to FIGS. 17-19 and 21, an optional illumination device may be incorporated into the personal armband storage device 310 for safety during low light conditions. One or both sides of the body portion 314 may include a transparent or translucent window 361. A single window 361 is illustrated in FIGS. 17 and 18, while a double window 361*a*, 361*b* is illustrated in FIG. 21. A first illumination unit 373*a* may project light through the first window 361*a*, while a second illumination unit 373*b* may project light through the second window 361*b*. The window 361 may be tinted if desired. For example, a red or green tinted window 361 may be used for safety. Moreover, the window 361 may be removable and interchangeable with a night vision goggle compatible color. The window 361 may even be tinted to only allow infrared light to pass through the window 361, which may be especially useful for covert military operations, for example. An interior pocket 363 may be formed within the storage compartment for securing a light assembly 371 within the storage compartment. The light assembly 371 may include one or more illumination units 373. In one embodiment, each illumination unit 373 may include one or more Light Emitting Diodes (LEDs) 375. In other embodiments, each illumination unit 373 may include another type of light source, such as an incandescent light bulb. The light source may emit electromagnetic radiation over a broad spectrum of frequencies. For example, the light source may emit white light, or colored light, such as red, green, blue, etc. The light source may also emit electromagnetic radiation in the infrared or ultraviolet spectrum if desired. The one or more illumination units 373 may be mounted on a body portion 376 that includes electrical connections between the illumination units 373 and a power source 377, such as a battery. In one embodiment, the power source is a cylindrical watch battery, but other power sources may be used, such as AA or AAA batteries. The body portion 376 may also include a switch 379 for activating the illumination units 373. The switch 379 may be activated by pushing on the switch 379, either directly, or through the body portion 314 of the personal armband storage device 310. The switch 379 may also control light emitting states of the illumination units 373. For example, repeatedly activating the switch 379 may cycle through steady, flashing, and off states of the illumination units 373. In other embodiments, the illumination units 373 may be mounted on adjustable joints, such as ball and socket joints, so that relative angles between the light emitted from the illumination units 373 may be adjusted.

Referring more specifically, to FIG. 18, each illumination unit 373, whether made up of a single light source or a plurality of light sources, may emit a cone-shaped or fan-shaped beam 381 of electromagnetic radiation. The fan-shaped beam 381 may include a central axis 383. The fan-shaped beam 381 may diverge from each side of the central axis 383 by a divergence angle A. The divergence angle may be in the range of between approximately 5 degrees and approximately 45 degrees, preferably in the range of between 10 degrees and 40 degrees, and more preferably in the range of between 15 degrees and 25 degrees. Moreover, the central axis 383 of a first fan-shaped beam 381 from a first illumination unit 373 may be oriented at a convergent angle B relative to a central axis of a second fan-shaped beam 381 from a second illumination unit 373. The convergent angle B may be in the range of between about 5 degrees and about 20 degrees, more preferably in the range of between about 10 degrees and about 20 degrees, and more preferably about 15 degrees. The particular ranges described for the divergence angle A and the convergent angle B result in optimal illumination of an area in front of a user during normal upper arm movement when running or walking.

Figure 20A:
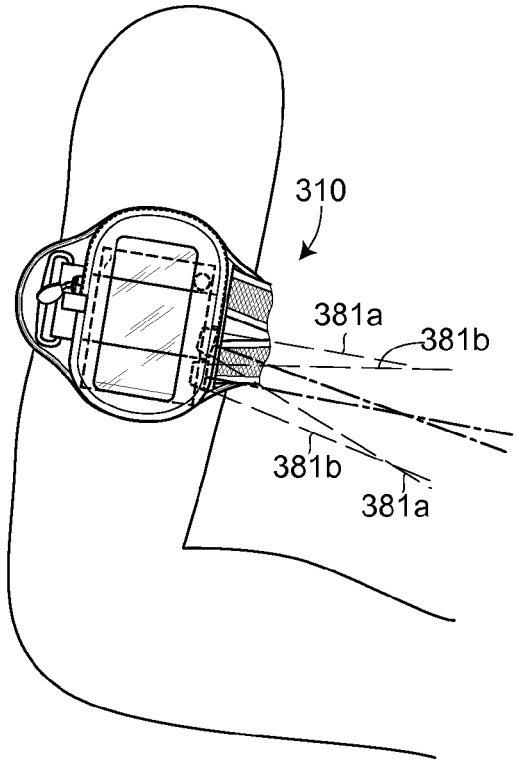
FIGS. 20A and 20B are front views of the personal armband storage device of FIG. 11, worn on a user's arm during a running stride.
Figure 20B:
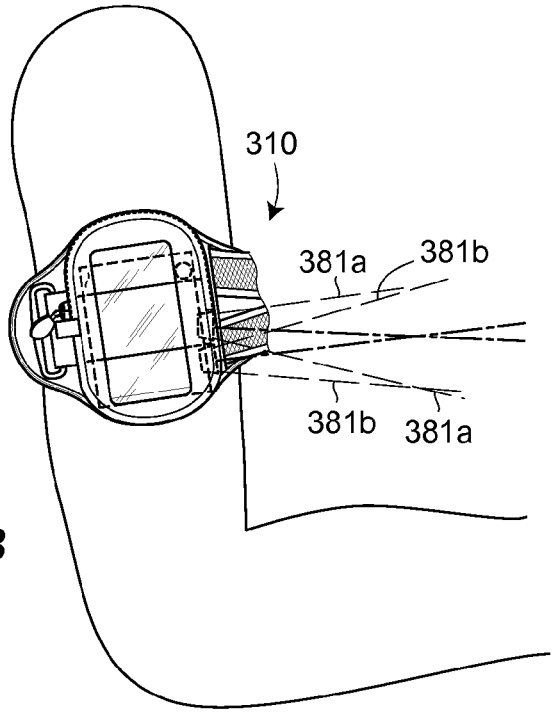

Referring now to FIGS. 20A and 20B, the personal armband storage device 310 is illustrated attached to an upper arm of a user during normal arm motion when running or walking. During a running or walking stride, normal arm movement helps balance the stride of a runner or walker. The upper arm naturally swings from a rearward position (as illustrated in FIG. 20A) to a forward position (as illustrated in FIG. 20B). This natural swing changes the relative positioning of the personal armband storage device 310. Illumination units 373 that emit fan-shaped beams, as described above, can be oriented so that the area in front of the user remains illuminated regardless of the position of the upper arm during running or walking. For example, when the upper arm is in the rearward position illustrated in FIG. 20A, the second fan-shaped beam 381*b* is illuminates a desired area in front of a user. When the upper arm swings into the forward position illustrated in FIG. 20B, the first fan-shaped beam 381*a* illuminates the desired area. Because the beams are fan-shaped, relative angles between the beams are formed that ensure a desired area in front of the user remains illuminated at all times.

Turning now to FIGS. 22-29, another alternate embodiment of a personal armband storage device 410 is illustrated. The embodiment illustrated in FIGS. 22-29 is similar to the embodiment illustrated in FIGS. 11-16 and like reference numbers are used to identify like elements, except that the reference numerals of like elements in FIGS. 22-29 will be 100 greater than the reference numeral of the like element in FIGS. 11-16.

In the embodiment of FIGS. 22-29, the strap 412 is attached to one side of the body portion 414. The strap 412 may include one or more perforations 421 that allow air to circulate between the strap 412 and the user's arm. In one embodiment, the perforations 421 may be approximately 1 mm in diameter, which results in efficient air movement, sweat evaporation, and cooling. The strap 412 may be made of a flexible material, such as neoprene and elastic, along with a moisture-wicking material, such as charcoal bamboo mesh. Bamboo mesh has the added benefit of inhibiting the growth of bacteria, mold, and mildew. One end of the strap 412 may include one part of a hook and loop fastener 496. At another side of the body portion 414, the sizing device 490 may be attached with a fabric connector 423. The soft material flap 498 may extend from one or both sides of the body portion 414 to protect a user's arm from the sizing device 490 and/or the strap 414.

Figure 24:
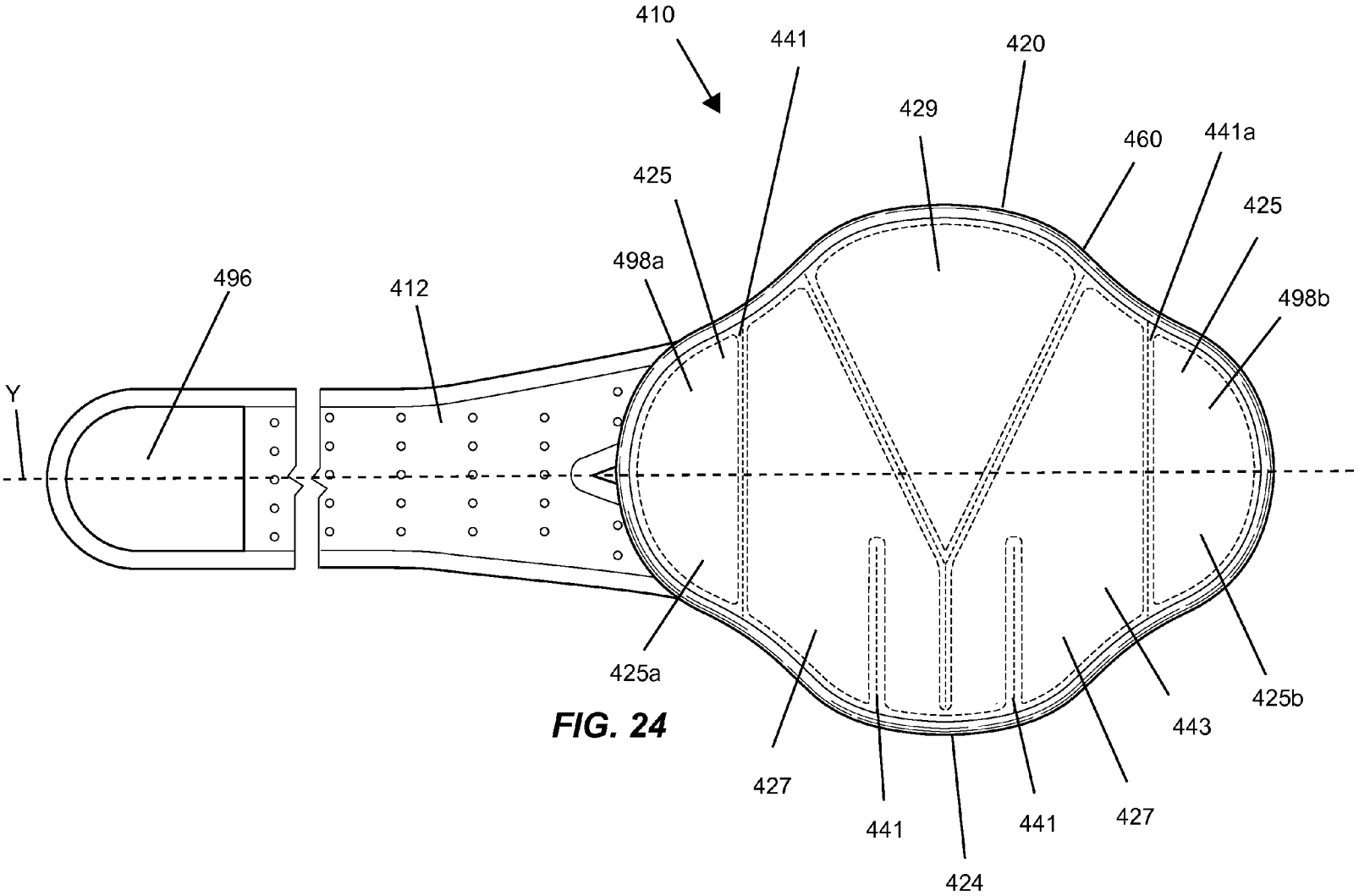
FIG. 24 is a back plan view of the personal armband storage device of FIG. 22.

Turning now more specifically to FIG. 24, a back of the body portion 414 may include a back plate 460 that supports the body portion 414 when the body portion 414 is attached to a human arm. The back plate 460 effectively increases contact area with the arm. This increased contact area increases friction against the skin or shirtsleeve, which results in resistance to slipping due to sweat or moisture accumulation. The back plate 460 may include a first region 425, a second region 427 that is thicker than the first region 425, and a third region 429 that is thicker than both the first and second regions 425, 427. In one embodiment, the third region 429 may be located near a center of the back plate 460 such that the second region 327 is located between the third region 429 and the first region 425. The differences in thickness may be formed by varying the thickness of a single layer of material, by, for example, bunching the material between stitches of thread, or by varying a number of layers of material that make up each region. The second region 427 and the third region 429 combine to fit within the natural recess in the musculature of the human upper arm, as discussed above. In some embodiments, the second region 427 and the third region 429 may be combined into a single region having a thickness that is greater than the thickness of the first region 425. The second region 427 and the third region 429 increase the effective contact area of the device, provide additional friction to prevent slipping, and stabilize and support the personal armband storage device 410 on the human upper arm when worn by a user.

The first region 425 may include a first portion 425*a* and a second portion 425*b* that are located laterally outward from the second region 427. In other words, the second region 427 may be located between the first portion 425*a* and the second portion 425*b*. The first portion 425*a* may be located proximate the strap 412, while the second portion 425*b* may be located on an opposite side of the body portion 414 from the first portion 425*a*. The first portion 425*a* may correspond to a first soft material flap 498*a* and the second portion 425*b* may correspond to a second soft material flap 498*b*. In other words, the first soft material flap 498*a* and the second soft material flap 498*b* may make up the thinnest parts of the back plate 460.

The back plate 460 may include one or more channels 441 formed in an outer surface 443 that direct sweat or other moisture away from the body portion 414. The channels 441 open outward, away from the body portion 414. In one embodiment, the channels 441 may be formed by stitching the outer surface 443 of the back plate 460. One channel 441*a* may be oriented substantially perpendicular to an axis Y of the strap 414 when the strap is stretched out in a plane, away from the body portion 414. Said another way, the channel 441*a* may be oriented substantially vertically (top 420 to bottom 424) when the personal armband storage device 410 is disposed on a human arm. This orientation takes advantage of gravity to funnel sweat or other moisture away from the back plate 460, thereby maintaining high levels of friction between the back plate 460 and the arm. Therefore, the personal armband storage device 410 is less susceptible to slippage during physical activity.

Figure 25:
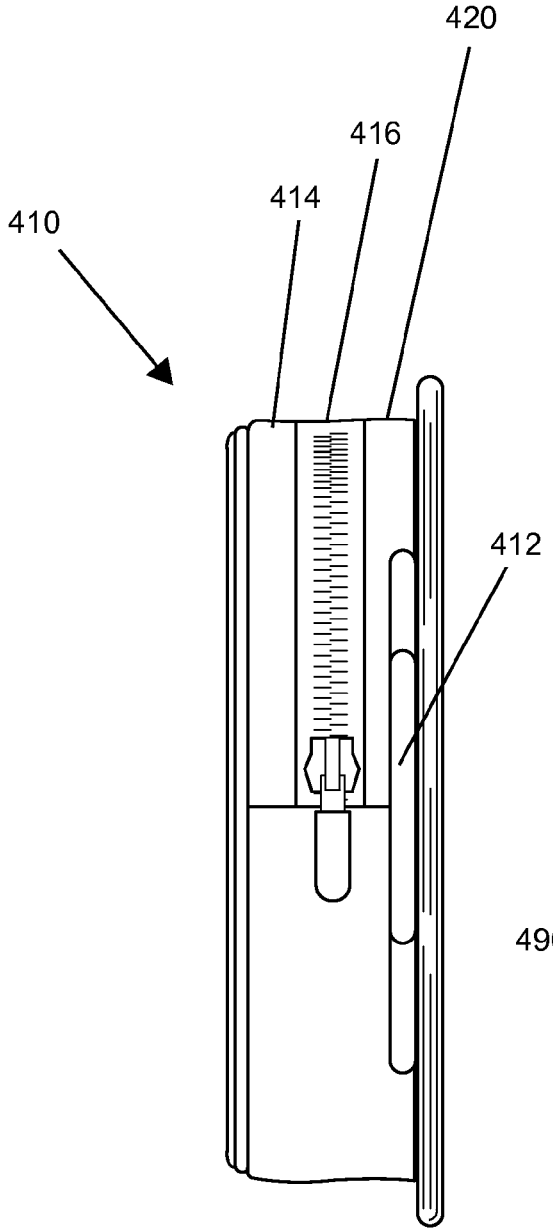
FIG. 25 is a left side view of the personal armband storage device of FIG. 22.
Figure 26:
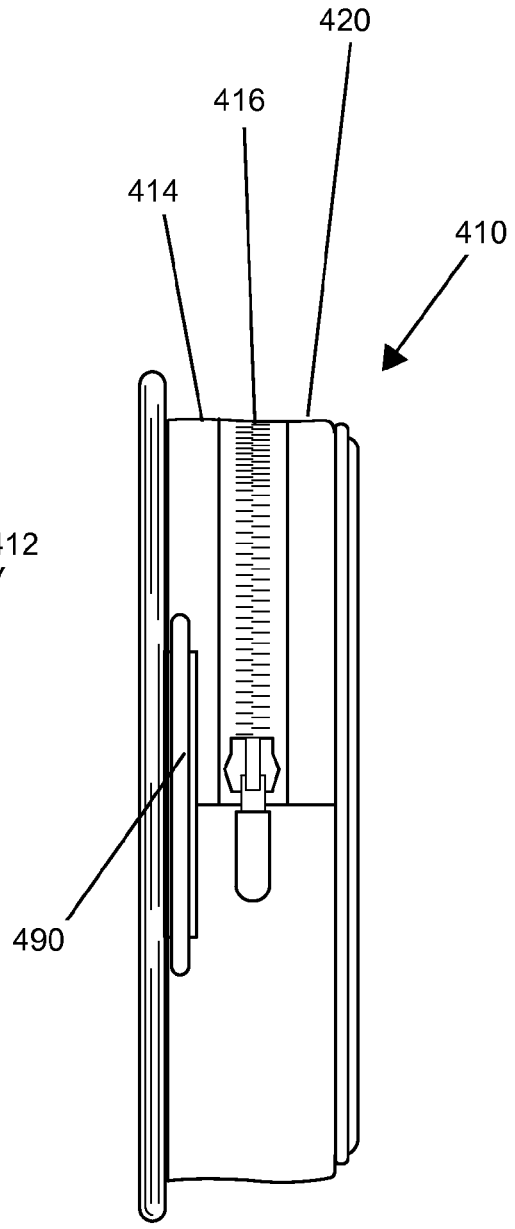
FIG. 26 is a right side view of the personal armband storage device of FIG. 22.

Referring now to FIGS. 25 and 26, right and left side views are illustrated. The body portion 412 includes an opening 416 in the top 420 that may be closed by a closing device, such as a zipper.

Figure 27:
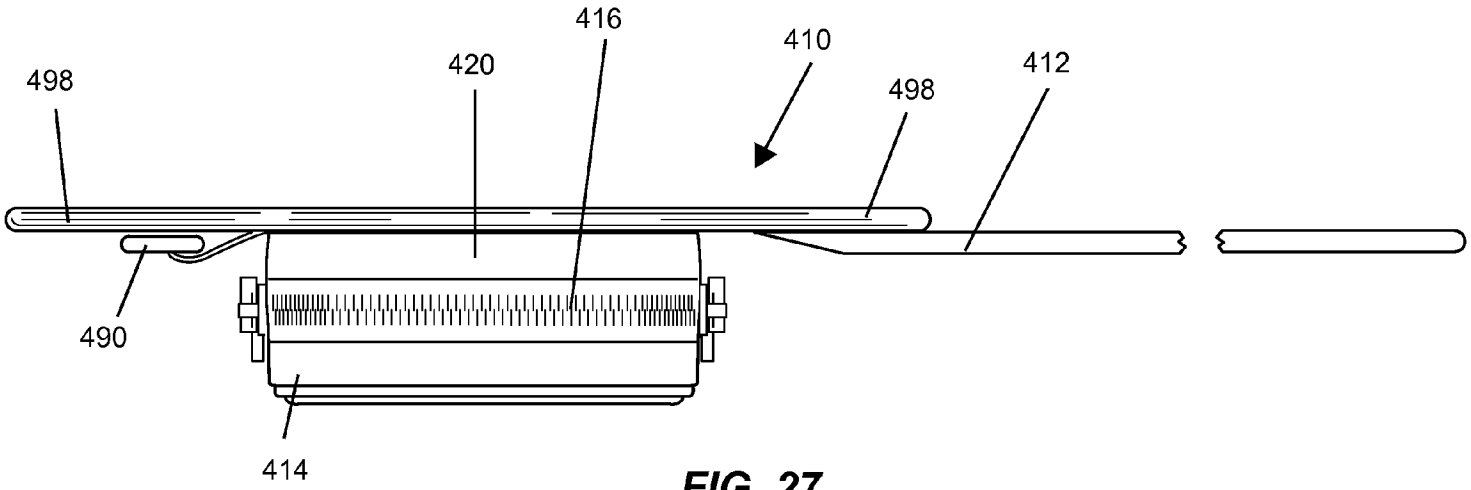
FIG. 27 is a top view of the personal armband storage device of FIG. 22.
Figure 28:
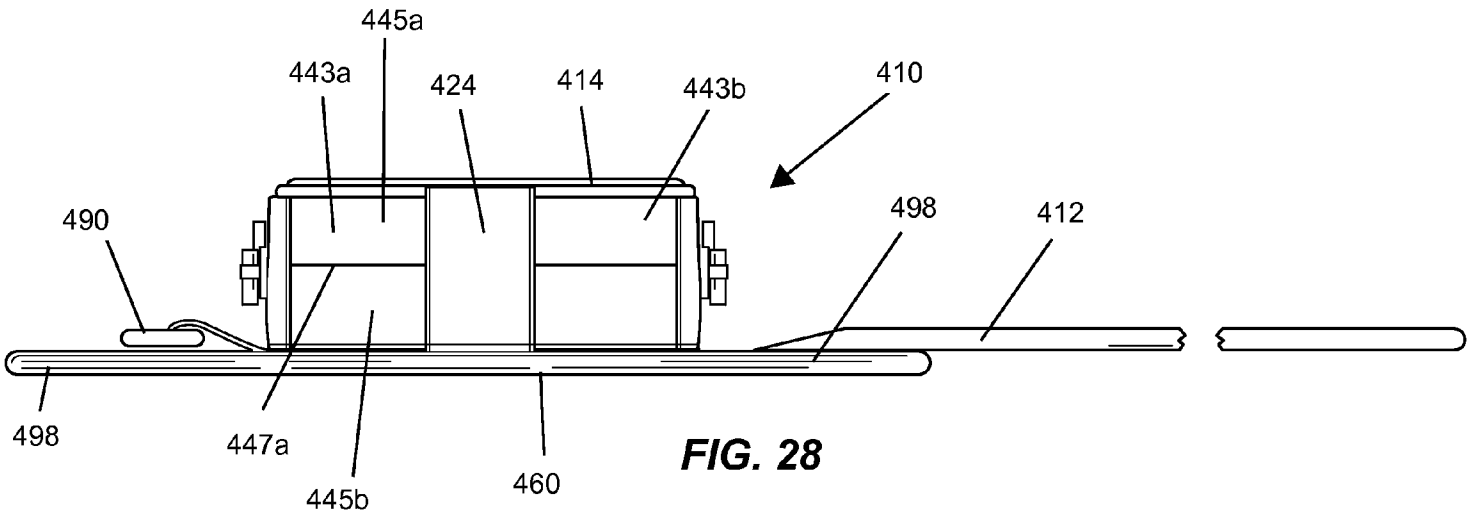
FIG. 28 is a bottom view of the personal armband storage device of FIG. 22.

Referring now to FIGS. 27 and 28, top and bottom views of the personal armband storage device 410 are illustrated. The top 420 of the body portion 414 includes an opening 416 that includes a releasable fastener, such as a zipper or hook and loop fastener, to allow a user to selectively open and close the opening 416 for accessing an interior storage compartment. The bottom 424 of the body portion 414 may include a first water resistant access port 443*a* and a second water resistant access port 443*b* that are sized to allow a portion of a device within the storage compartment, such as a music player or cell phone ear piece cord, to extend out of the storage compartment so that a user may use the device while the device is stored within the storage compartment. The access ports 443*a*, 443*b* may be formed of two plies of overlapping fabric (e.g., an inner ply 445*a* and an outer ply 445*b*), in one example. The outer ply 445*b* may have an edge 447*a* that is oriented substantially parallel to the back plate 460. In some embodiments, the edge 447*a* (and thus the opening) preferably are between 5 mm and 25 mm in length, more preferably between 6 mm and 22 mm in length, and even more preferably between 7 mm and 20 mm in length. These lengths provide near optimum flexibility to accommodate a wide range of phones and other electronic devices.

From a purely functional standpoint, a preferred access port might simply include a water resistant opening of some sort. The access port illustrated here, on the other hand, has an alternative, ornamental arrangement for the first and second plies 445*a*, 445*b* in which the edge 447*a* is oriented parallel to the back plate 460. This illustrated arrangement may add to the cost of manufacture, so the illustrated access port does not provide all of the possible economic advantages that might be derived from the invention. On the other hand, this arrangement is believed to be aesthetically pleasing and is likely to be recognized and relied upon by purchasers to identify the source of the personal armband storage device.

Other examples of access ports include flexible plastic or rubber petals. Regardless, an opening of the access port 443 must be flexible enough to allow a larger end (such as an earpiece, or a plug) to pass through the opening so that a cord may be threaded through the opening and connected to the device within the storage compartment. The access port 443 may form a water resistant seal that prevents damage to electronic devices stored within the storage compartment from environmental factors, such as dust, dirt, sand, water, sweat, etc.

By locating the access ports 443 on the bottom 424 of the body portion 414, the access ports 443 are somewhat shielded from environmental conditions, such as rain, sleet, or dirt, thereby better protecting items stored in the storage compartment. Additionally, the access ports 443 being located in the bottom 424 of the body portion 414 unexpectedly resulted in better orientation of earphone cords for some phones, personal data assistants, and compact music players. More specifically, some phones, personal data assistants, and compact music players, such as iphones and ipods have headphone jack disposed in the top or upper portion of the device. When wearing the disclosed personal armband storage device, it has been found, unexpectedly, that placing the phone or music player in the storage compartment upside down relative to the opening, results in screen of the device being more readable when the personal armband storage device is disposed on the upper arm. This is because the user is looking down the arm to look at the device, which results in a correct relative orientation between the eyes and the device, thereby making reading the device relatively easy. Because some headphone jacks are located in the top of the device, and the device is inserted into the storage compartment upside down, the headphone jacks end up being located next to the access ports 443. As a result, headphone cords are more easily threaded through the access ports 443. Moreover, the access ports 443 maintain a water resistant barrier because they are disposed on the bottom of the personal armband storage device. As a result, the device stored in the storage compartment is more protected.

The personal armband storage devices described herein allow a user to carry greater weights of personal items than prior art storage devices, while avoiding slipping and discomfort common with other storage devices. This benefit is due at least in part to the back plate and the V-shaped strap described herein. Both the back plate and with the V-shaped strap enhance stabilization of the personal armband storage device by increasing the effective contact area, while distributing weight across a larger area and by maintaining friction between the personal armband storage device and a user's arm thereby reducing slippage. In addition, the perforated moisture-wicking mesh fabric and the breathable memory foam that form the back plate provide superior air circulation and thus excellent evaporation and cooling of the skin of the upper arm. By keeping the skin dry, friction between the personal armband storage device and the upper arm is increased, which significantly reduces the possibility of the device slipping down the wearer's arm during extreme physical activities and the full-range of arm movements.

The personal armband storage device described above is designed for optimal placement on a user's upper arm. The upper arm is subject to smaller forces during physical activity than other, more extreme, parts of the body, or lower portions of the arm. For example, items placed on the wrist (or even closer to the elbow) are subjected to exponentially greater forces than the same device located on the upper arm. As a result, locations farther from a center of rotation are subject to greater forces for the same angular speed. For example, a one pound storage device located on the wrist of a runner that is two feet from the shoulder (i.e., the center of rotation of the arm during running), which is rotating at 1 foot per second, is subjected to a force over 4 times greater than the force of an identical storage device located four inches from the same center of rotation (i.e., the shoulder). By locating the personal armband storage device on the upper arm, and in particular to conform to the musculature of the upper arm between the biceps, triceps, and deltoid muscles, and by forming the back plate from visco-elastic memory foam and moisture wicking material and attaching the back plate to a V-shaped strap, the personal armband storage device described herein produces superior stability and resistance to slipping during rigorous physical activity. The advantageous features described herein need not be used in combination, but could also be used separately in other embodiments of the personal armband storage device.

The personal armband storage device produces the superior comfort, stability and resistance to slipping by using at least six unique and novel structural elements, any one of which will increase stability and resistance to slipping on its own. First, friction between the storage device and the upper arm is increased by forming a back plate that is larger than the size of a storage compartment. Second, surface area contact between the back plate and the upper arm is increased by covering the back plate with breathable, visco-elastic memory foam padding that will contour to the shape and musculature of the wearer's upper arm. Third, friction between the back plate and the upper arm is further increased by covering visco-elastic memory foam with a semi-course, moisture-wicking mesh/webbed fabric that will allow air to circulate between the memory foam padding and mesh/webbed fabric thereby promoting enhanced moisture evaporation, which reduces moisture accumulation and increases friction between the upper arm and the back plate. Fourth, effective compressibility (tension) increased by splitting the ends of the V-shaped strap and attaching the split ends to upper and lower sides of the storage compartment. The V-shaped strap provides a wider dispersion of the tension force across the area of the storage compartment. Fifth, the memory foam padded back plate may be extended so that the V-shape strap rests, at least partially, over the extended sections, further increasing the effective contact area against the upper arm (which increases friction) without the need to increase the width of the connecting strap itself. This element also has the added benefit of enhancing the wearer's comfort as the return loop and the split compression strap rest on top of the foam padded back plate and do not contact the wearer's arm. Sixth, strap perforations for venting air circulation holes mitigate the formation of sweat, which maintains greater friction between the back plate and the upper arm. This feature further enhances the wearer's comfort as the evaporative cooling effect not only keeps the skin beneath the back plate free from moisture, but also reduces the temperature of the skin, which further reduces generation of perspiration. Optionally, the V-shaped strap may be lined with moisture-wicking mesh fabric, which like the back plate would pull the moisture away from the upper arm for increased evaporation and friction.

These six features synergistically solve slipping problems that have plagued previous extremity attached storage devices. Even during the most extreme physical activities, the personal armband storage device described herein maintains adequate friction between the upper arm and the back plate to prevent slipping, while minimizing the tension applied to the V-shaped strap. As a result, the disclosed personal armband storage device allows the wearer to comfortably carry an unprecedented number of items and weight (including water/energy drinks/flashlight) inside the storage compartment without adversely impacting the wearer's performance.

While the present invention has been related in terms of the foregoing embodiments, those skilled in the art will recognize that the invention is not limited to the embodiments depicted. The present invention can be practiced with modification and alteration within the spirit and scope of the appended claims. Thus, the description is to be regarded as illustrative instead of restrictive on the present invention.

In one or more of the foregoing examples, the description uses terms such as upper, lower, front, back, top, bottom, inwardly and/or outwardly. These terms are relative only and are to be used in the context of describing the exemplary embodiments when positioned as shown in the Figures. Those of skill in the art will readily understand that personal armband storage devices may be positioned in different orientations than those shown in the Figures and those of skill in the art can readily understand how to adapt these relative terms to alternate orientations of the subject personal armband storage devices.

While the personal armband storage device has been described with respect to certain embodiments thereof, it will be understood by persons of ordinary skill in the art that the appended claims are not intended to be limited thereto, and that modifications can be made that are considered within the scope of the claims.

The invention claimed is:

1. A personal armband storage device comprising:

a body portion having an opening for access to a storage compartment contained within the body portion;

a back plate attached to the body portion, the back plate including a first region having a first thickness and a second region having a second thickness, the second thickness being greater than the first thickness; and a strap attached to the back plate for securing the body portion to an arm of a user, the strap forming an armband, wherein the first region includes a first portion and a second portion that are located laterally outward from the second region, the second region being located between the two portions of the first region, the first portion of the first region and the second portion of the first region being separated from one another by the second region so that the first portion of the first region and the second portion of the first region are not connected to one another along an outer surface of the back plate that is located opposite of the body portion, the first portion of the first region being separated from the second region by a first straight channel that is oriented substantially perpendicular to an axis of the strap, and the second portion of the first region is separated from the second region by a second straight channel that is oriented substantially perpendicular to the axis of the strap, the first and second straight channels forming depressions or recesses in the outer surface of the back plate, and wherein the back plate includes a third region having a third thickness, the third thickness being greater that the first thickness and greater than the second thickness, the third region being located towards a center of the back plate, the second region being located between the third region and the first region.

2. The personal armband storage device of claim 1, wherein the first portion of the first region is located proximate the strap and the second portion of the first region is located on an opposite side of the body portion from the first portion of the first region.

3. The personal armband storage device of claim 1, wherein a first soft material flap extends from one side of the back plate and a second soft material flap that extends from an opposite side of the back plate, the first soft material flap being located between the strap and a human arm when the personal armband storage device is attached to a human arm, and the second soft material flap being located between a sizing device and a human arm when the personal armband storage device is attached to a human arm.

4. The personal armband storage device of claim 1, wherein the first straight channel and the second straight channel open away from the body portion, and the first straight channel and the second straight channel direct fluids away from the body portion.

5. The personal armband storage device of claim 1, wherein the body portion includes a transparent window and a window strap disposed within the storage compartment, the window strap being located adjacent to an inner surface of the window.

6. The personal armband storage device of claim 1, further comprising a plurality of pockets disposed in the storage compartment.

7. The personal armband storage device of claim 6, wherein at least one pocket includes an angled top edge.

8. The personal armband storage device of claim 1, wherein the back plate is wider than the body portion.

9. The personal armband storage device of claim 1, wherein at least one of the channels is formed by stitching located on the back plate.

10. The personal armband storage device of claim 1, wherein the body portion includes a releasable fastener located in a top surface of the body portion, proximate the opening, for selectively opening and closing the opening and a water resistant access port located on a bottom surface of the body portion, opposite the opening, the water resistant access port providing access for an electrical cord to extend from the storage compartment to the outside of the body portion.

11. The personal armband storage device of claim 10, wherein the water resistant access port is formed by two overlapping fabric plies.

12. The personal armband storage device of claim 10, wherein an outer ply of overlapping fabric has an edge that is oriented substantially parallel to the back plate, while the outer ply is planar and oriented perpendicular to the back plate.

13. The personal armband storage device of claim 5, wherein the window strap includes a silicone coating on one side.

* * * * *